United States Patent [19]

Ohkawara et al.

[11] Patent Number: 4,739,740

[45] Date of Patent: Apr. 26, 1988

[54] INTERNAL COMBUSTION ENGINE AIR-FUEL RATIO FEEDBACK CONTROL METHOD FUNCTIONING TO COMPENSATE FOR AGING CHANGE IN OUTPUT CHARACTERISTIC OF EXHAUST GAS CONCENTRATION SENSOR

[75] Inventors: Kenichi Ohkawara; Eiji Kishida; Takeo Kiuchi; Eitetsu Akiyama, all of Wako, Japan

[73] Assignee: Honda Giken Kogyo Kabushiki Kaisha, Japan

[21] Appl. No.: 57,049

[22] Filed: Jun. 1, 1987

[30] Foreign Application Priority Data

Jun. 6, 1986 [JP] Japan ..... 61-132570
Jan. 30, 1987 [JP] Japan ..... 62-020747

[51] Int. Cl.[4] ..... F02D 41/14
[52] U.S. Cl. ..... 123/489; 123/440
[58] Field of Search ..... 123/440, 489

[56] References Cited

U.S. PATENT DOCUMENTS 4,121,548 10/1978 Hattori et al. ..... 123/489 X
4,167,925 9/1979 Hosaka et al. ..... 123/489 X
4,177,787 12/1979 Hattori et al. ..... 123/440 X
4,237,829 12/1980 Asano et al. ..... 123/440 X
4,375,796 3/1983 Ohgami et al. ..... 123/489 X
4,408,584 10/1983 Yabuhara et al. ..... 123/440
4,461,258 7/1984 Becker et al. ..... 123/489 X
4,491,921 1/1985 Sugiyama et al. ..... 123/489 X
4,624,232 11/1986 Saito et al. ..... 123/440 X

*Primary Examiner*—Tony M. Argenbright
*Attorney, Agent, or Firm*—Charles S. McGuire

[57] ABSTRACT

A method of feedback-controlling the air-fuel ratio of a mixture, supplied to an internal combustion engine, by at least one of proportional control and integral control in dependence upon the results of a comparison between the output of an exhaust gas concentration sensor and a predetermined reference value. The method includes obtaining the ratio of a first time period required for an output value from the exhaust gas concentration sensor to make a transition from a peak value on a rich side to a predetermined reference value with respect to the predetermined reference value, and a second time period required for the output value to make a transition from a peak value on a lean side to the predetermined reference value with respect to the predetermined reference value, and altering, in dependence upon the ratio obtained, at least one predetermined control factor applied to control of the air-fuel ratio.

13 Claims, 10 Drawing Sheets

| FIG.5 | |
|---|---|
| FIG.5a | FIG.5b |

INTERNAL COMBUSTION ENGINE AIR-FUEL RATIO FEEDBACK CONTROL METHOD FUNCTIONING TO COMPENSATE FOR AGING CHANGE IN OUTPUT CHARACTERISTIC OF EXHAUST GAS CONCENTRATION SENSOR

BACKGROUND OF THE INVENTION

This invention relates to an air-fuel ratio feedback control method for an internal combustion engine, and more particularly, to such air-fuel ratio feedback control method adapted to compensate for a aging change in the output characteristic of an exhaust gas concentration sensor arranged in the exhaust system of the engine.

A commonly employed air-fuel ratio feedback control method for internal combustion engines is described in e.g. Japanese Provisional Patent Publication (Kokai) No. 57-137633. In accordance with this conventional method, a value of exhaust gas concentration (oxygen concentration) sensed by an exhaust gas concentration sensor (hereinafter referred to as the "$O_2$ sensor"), which is arranged in the exhaust system of the engine, and a predetermined reference value are compared. Based on the results of the comparison, the air-fuel ratio of the mixture supplied to the engine is subjected to feedback control to obtain a stoichiometric mixture ratio that will maximize the conversion efficiency of a three-way catalyst arranged in the engine exhaust system, thereby improving the exhaust emission characteristics.

The $O_2$ sensor employed in the above system uses a substance such as zirconium oxide as a sensing element. Utilizing the fact that the amount of oxygen ion which permeates the interior of the zirconium oxide varies depending upon the difference between the partial pressure of oxygen in the atmosphere and the partial pressure of oxygen contained in the exhaust gas, the $O_2$ sensor senses the exhaust gas oxygen concentration by outputting a voltage which varies as a function of the above-mentioned variation in partial pressure difference.

However, it is known that an $O_2$ sensor of the aforementioned construction has an output characteristic that changes with the passage of time, and particularly the sensor output characteristic deteriorates when a vehicle equipped with the sensor is put through an endurance run. As time passes, therefore, the controlled air-fuel ratio becomes richer in comparison with that exhibited by the vehicle at shipment from the factory, despite the fact that the feedback control of the air-fuel ratio is performed under the same conditions. Engine operating performance (e.g. driveability), fuel consumption and exhaust emission characteristics are adversely affected unless some measures are taken to deal with this aging change in $O_2$ sensor output characteristic.

SUMMARY OF THE INVENTION

It is therefore an object of the invention to provide an internal-combustion engine air-fuel ratio feedback control method adapted to attain a target air-fuel ratio at all times by correcting the air-fuel ratio of a mixture supplied to the engine in dependence upon an aging change in the output characteristic of the $O_2$ sensor, thereby improving engine operating performance, fuel consumption and exhaust gas characteristics.

According to the present invention, there is provided a method of feedback-controlling an air-fuel ratio of a mixture supplied to an internal combustion engine having an exhaust system and a sensor arranged in the exhaust system for sensing exhaust gas concentration, including comparing an output value from the exhaust gas concentration sensor and a predetermined reference value, and feedback-controlling the air-fuel ratio of the mixture to a desired value by at least one of proportional control and integral control depending upon the results of the comparison, the proportional control including correcting the air-fuel ratio by a first correction value when the output value from the exhaust gas concentration sensor changes from a rich side to a lean side or vice versa with respect to the predetermined reference value, and the integral control including correcting the air-fuel ratio by a second correction value whenever a predetermined time period elapses, as long as the output value from the exhaust gas concentration sensor is on the lean side or rich side with respect to the predetermined reference value.

The method of the invention is characterized by an improvement comprising the following steps: (a) calculating a first time period required for the output value from the exhaust gas concentration sensor to make a transition from a peak value on the rich side to the predetermined reference value with respect to the predetermined reference value; (b) calculating a second time period required for the output value to make a transition from a peak value on the lean side to the predetermined reference value with respect to the predetermined reference value; (c) obtaining a ratio of the calculated first time period to the calculated second time period; and (d) altering a value of at least one predetermined control factor applied to control of the air-fuel ratio in dependence upon the ratio obtained.

The predetermined control factors include the first correction value applied to the proportional control, the second correction value applied to the integral control, and the predetermined reference value compared with the output value from the exhaust gas concentration sensor.

In a preferred embodiment, the value of the predetermined control factor is altered by a larger amount when the ratio of the first time period to the second time period indicates an increase in a deviation of the air-fuel ratio from the desired value.

In a preferred embodiment, the first time period and the second time period are each measured a predetermined number of times, a first average value of the first time period measured the predetermined number of times and a second average value of the second time period measured the predetermined number of times are calculated, a ratio of the first average value to the second average value is obtained, and the value of the at least one predetermined control factor is altered in dependence upon the obtained ratio.

In another preferred embodiment, the predetermined number of times is set to a smaller value and/or the averaging rate of the first time period and of the second time period is set to a larger value when the ratio of the first time period to the second time period indicates an increase in a deviation of the air-fuel ratio from the desired value.

The above and other objects and advantages of the invention will become more apparent from the following description taken in conjunction with the accompanying drawings.

BRIEF DESCRIPTION OF THE DRAWINGS

FIGS. 5, 5*a* and 5*b* are a flowchart illustrating a subroutine for determining a proportional control correction value $P_R$ in accordance with the first embodiment of the invention;

DETAILED DESCRIPTION

Preferred embodiments of a method in accordance with the invention will now be described with reference to the accompanying drawings.

Figure 1:
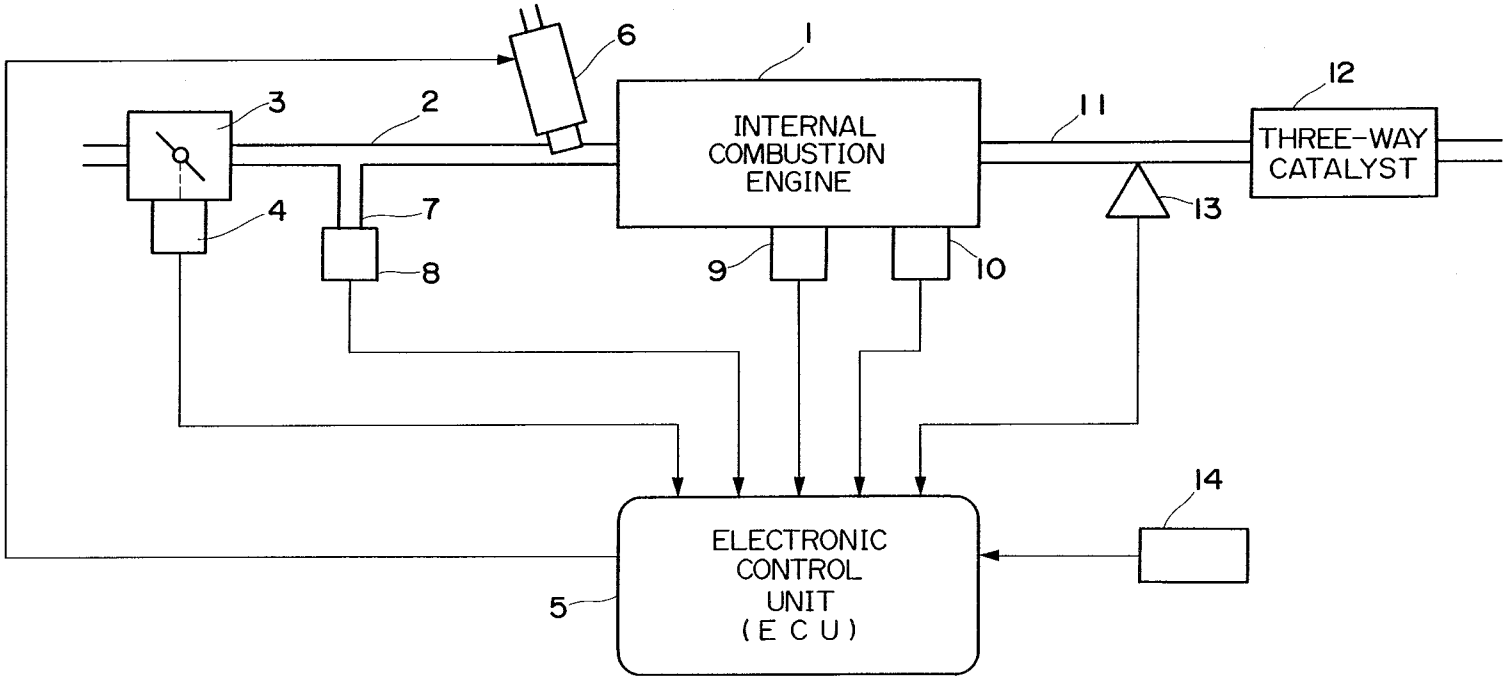
FIG. 1 is a block diagram illustrating the overall construction of an air-fuel ratio control system for practicing the method of the invention.

FIG. 1 is a block diagram illustrating the overall construction of an internal combustion engine fuel supply control system to which the method of the invention is applied. The internal combustion engine, designated by numeral 1, is e.g. of the four-cylinder type and has an intake pipe 2 connected thereto. The intake pipe 2 is in communication with the atmosphere and is provided at a point along its length with a throttle valve 3. A throttle valve opening sensor 4 is connected to the throttle valve 3 for sensing the opening θTH thereof and outputting an electric signal indicative thereof. This signal is delivered to an electronic control unit (hereinafter referred to as the "ECU") 5, which controls the engine by executing processing for calculating such quantities as air-fuel ratio, as will be described hereinbelow.

A fuel injection valve 6 for each one of the cylinders of engine 1 is provided in the intake pipe 2 between the engine 1 and the throttle valve 3. The fuel injection valve 6 is connected to a fuel pump, not shown, and is electrically connected to the ECU 5. The time during which the fuel injection valve 6 is opened to inject fuel into the engine is controlled by a driving signal supplied to it by the ECU 5.

Connected to the intake pipe 2 via a pipe 7 with an absolute pressure (PBA) sensor 8 at a point downstream of the throttle valve 3 is an absolute pressure sensor 8 for sensing absolute pressure PBA in the intake pipe 2 and for outputting a signal indicative thereof to the ECU 5.

Mounted in the cylinder wall of engine 1, which is filled with a coolant, is an engine temperature sensor 9 comprising e.g. a thermister for sensing the temperature TW of the coolant and for outputting a signal indicative thereof to the ECU 5.

An engine rotational speed sensor (hereinafter referred to as the "Ne sensor") 10 is arranged in facing relation to the engine camshaft or crankshaft, not shown. The Ne sensor 10 outputs a single pulse (hereinafter referred to as the "TDC" signal) whenever the engine crankshaft rotates through 180°. The TDC signal is delivered to the ECU 5.

The engine 1 has an exhaust pipe 11 in which a three-way catalyst 12 is arranged for scrubbing toxic components HC, CO and NOx in the exhaust gases. Mounted in the exhaust pipe 11 upstream of the three-way catalyst 12 is an $O_2$ sensor 13 serving as an exhaust gas concentration sensor. The $O_2$ sensor senses the concentration of oxygen in the exhaust gases and provides the ECU 5 with its output signal ($VO_2$) indicative of the oxygen concentation sensed.

Also connected to the ECU 5 is a vehicle velocity sensor 14 for sensing the velocity Sp of the vehicle in which the engine is mounted and for providing the ECU 5 with a signal signal indicative of the velocity sensed.

The ECU 5 calculates a fuel injection time TOUT, during which fuel is injected by the fuel injection valve 6, by using the following equation, based on input signals from the various aforementioned sensors:

$$TOUT = Ti \times K_1 \times KO_2 + K_2 \quad (1)$$

where Ti represents a basic fuel injection time of the fuel injection valve 6. By way of example, the basic fuel injection time Ti is read out of an internal memory of the ECU 5 on the basis of the absolute pressure PBA in the intake pipe and the engine rotational speed Ne. Further, $KO_2$ is an $O_2$ feedback correction coefficient, which is calculated by an $O_2$ feedback correction coefficient calculation subroutine, described hereinbelow. $K_1$ and $K_2$ represent correction coefficients and correction variables, respectively, calculated in dependence upon the various engine parameter signals. $K_1$ and $K_2$ are set, on the basis of the output signals from the aforementioned sensors, to values which optimize such characteristics as the fuel consumption characteristic and engine accelerability dependent upon the engine operating conditions.

The ECU 5 outputs a driving signal, which opens the fuel injection valve 6, corresponding to the fuel injection time TOUT obtained as set forth above.

Figure 2:
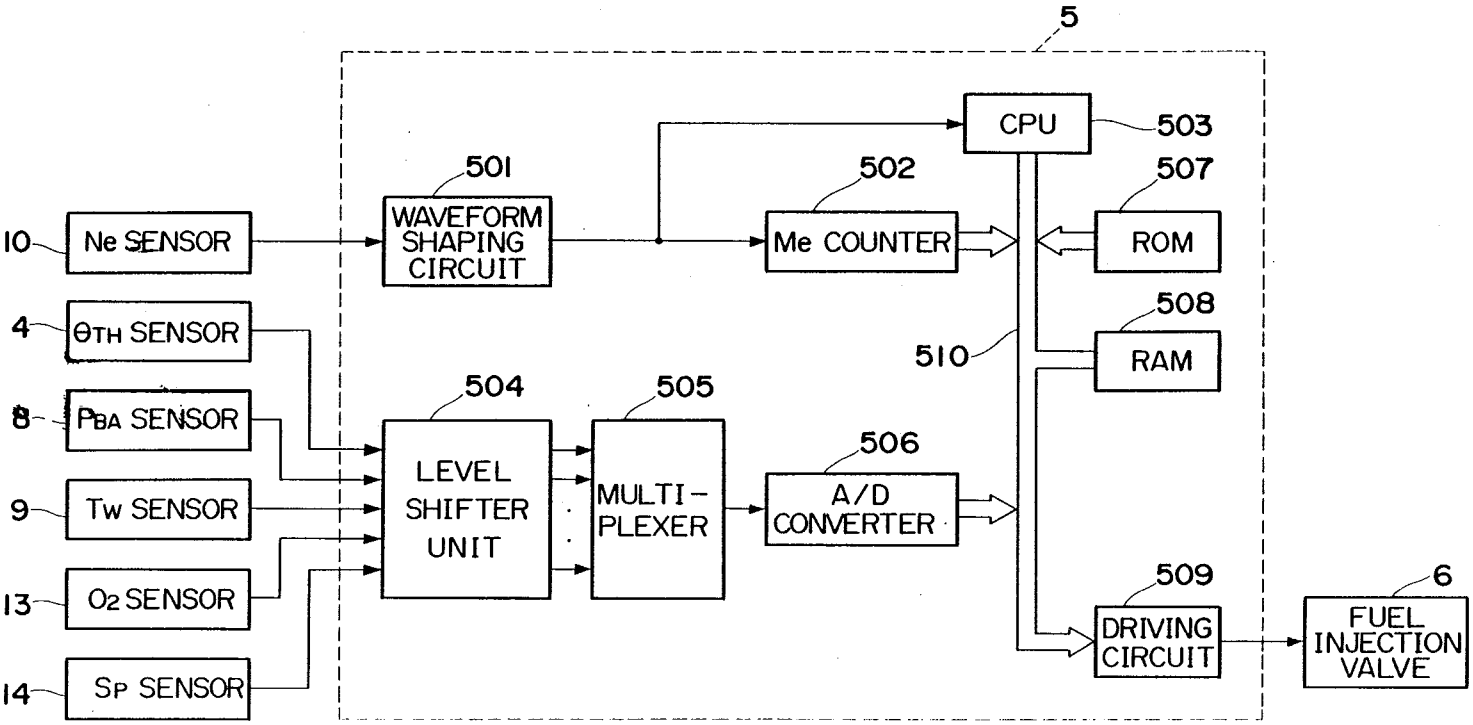
FIG. 2 is a block diagram illustrating the internal construction of an electronic control unit shown in FIG. 1.

The internal circuit construction of the ECU 5 of FIG. 1 is illustrated in the block diagram of FIG. 2. The TDC signal from the Ne sensor 13 has its waveform shaped by a waveform shaping circuit 501 and then it is applied to a central processing unit (hereinafter referred to as the "CPU") 503, and to a counter (hereinafter referred to as the "Me counter") 502 for measuring the rotational speed of the engine. The latter counts the time interval between successive inputs of the TDC signal pulse from the Ne sensor 10, and the value Me of the count recorded thereby is proportional to the reciprocal of the rotational speed Ne of the engine. The Me counter applies the counted value Me to the CPU 503 via a data bus 510.

The output signals from the throttle valve opening ($\theta$TH) sensor 4, absolute pressure (PBA) sensor 8, coolant temperature (TW) sensor 9, $O_2$ sensor 13 and vehicle velocity (SP) sensor 28 are applied to a level shifter unit 504 to be shifted to a predetermined voltage level thereby before being successively inputted to an analog/digital converter (A/D converter) 506 by a multiplexer 505, which operates on the basis of a command received from the CPU 503. The A/D converter 506 successively converts the level-shifted output signals from the aforementioned sensors into digital signals which are then fed into the CPU 503 via a data bus 510.

The CPU 503 is connected via the data bus 510 to a read-only memory (hereinafter referred to as the "ROM") 507, a random-access memory (hereinafter referred to as the "RAM") 508 and a driving circuit 509. The ROM 507 stores various control programs executed by the CPU 503, as will be described in detail later, and data such as correction coefficients and correction variables, the details of which will be described later. The RAM 508 temporarily stores the results of processing obtained by execution of the aforementioned control programs by the CPU 503.

In accordance with the control program, and as will be described in further detail below, the CPU 503 reads or calculates the values of coefficients and variables, which conforms to the output signals from the various sensors, out of the ROM 507, computes the fuel injection time TOUT of the fuel injection valve 6 on the basis of Equation (1), and supplies the driving circuit 509 with the computed value of TOUT via the data bus 510. The driving circuit 509 responds by opening the fuel injection valve 6 for a period of time corresponding to the computed value of TOUT.

The inventive method of calculating the $O_2$ feedback coefficient $KO_2$, which conforms to the aging change in the output characteristic of the $O_2$ sensor 13, will now be described.

As mentioned above, the output characteristic of an $O_2$ sensor deteriorates due to persistent running of a vehicle, as a result of which the feedback-controlled air-fuel ratio has a tendency to shift to the rich or lean side. The degree to which the $O_2$ sensor deteriorates can be estimated by a value KOX (=TLV/TRV). This represents the ratio of a time period TRV (t2−t3 in FIG. 3), which is required for the output voltage value (FIG. 3) of the $O_2$ sensor under stable engine operating conditions to shift from a peak value (maximum value) on the rich side to a reference value VREF, to a time period TLV (t6−t7 in FIG. 3), which is required for the output voltage value to shift from a peak value (minimum value) on the lean side to the reference value VREF. It has been verified experimentally that the value of KOX decreases in dependence on cumulative traveling distance of the vehicle, namely the degree of aging deterioration of the $O_2$ sensor. In the present specification, the term "peak value" (maximum value and minimum value) is taken to be the output voltage value $VO_2$ which prevails at the instant that $VO_2$, which is varying in a direction away from the reference value line VREF, reverses itself to begin varying toward the reference value line VREF.

Therefore, in air-fuel ratio feedback control, described below, as practiced in accordance with the invention, the air-fuel ratio is accurately controlled to attain a target air-fuel ratio by altering a predetermined air-fuel ratio control factor by an amount conforming to the value of KOX. The air-fuel ratio control factor refers to a factor which, when the value thereof changes, causes the air-fuel ratio to be controlled correspondingly to a value different from that to which it was controlled by the value of the factor before the change. Examples of air-fuel ratio control factors include a proportional control correction value, an integral control correction value, which are added to or subtracted from the correction coefficient $KO_2$ in air-fuel ratio feedback control, and the reference value VREF of the $O_2$ sensor output value.

Figure 4:
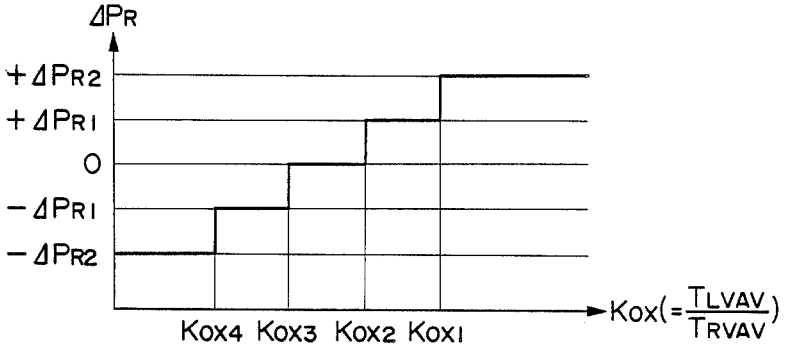
FIG. 4 is a graph showing the relationship between a value KOX, which represents the degree of deterioration of the $O_2$ sensor, and a correction value ΔPR in a first embodiment of the invention.
Figure 5A:
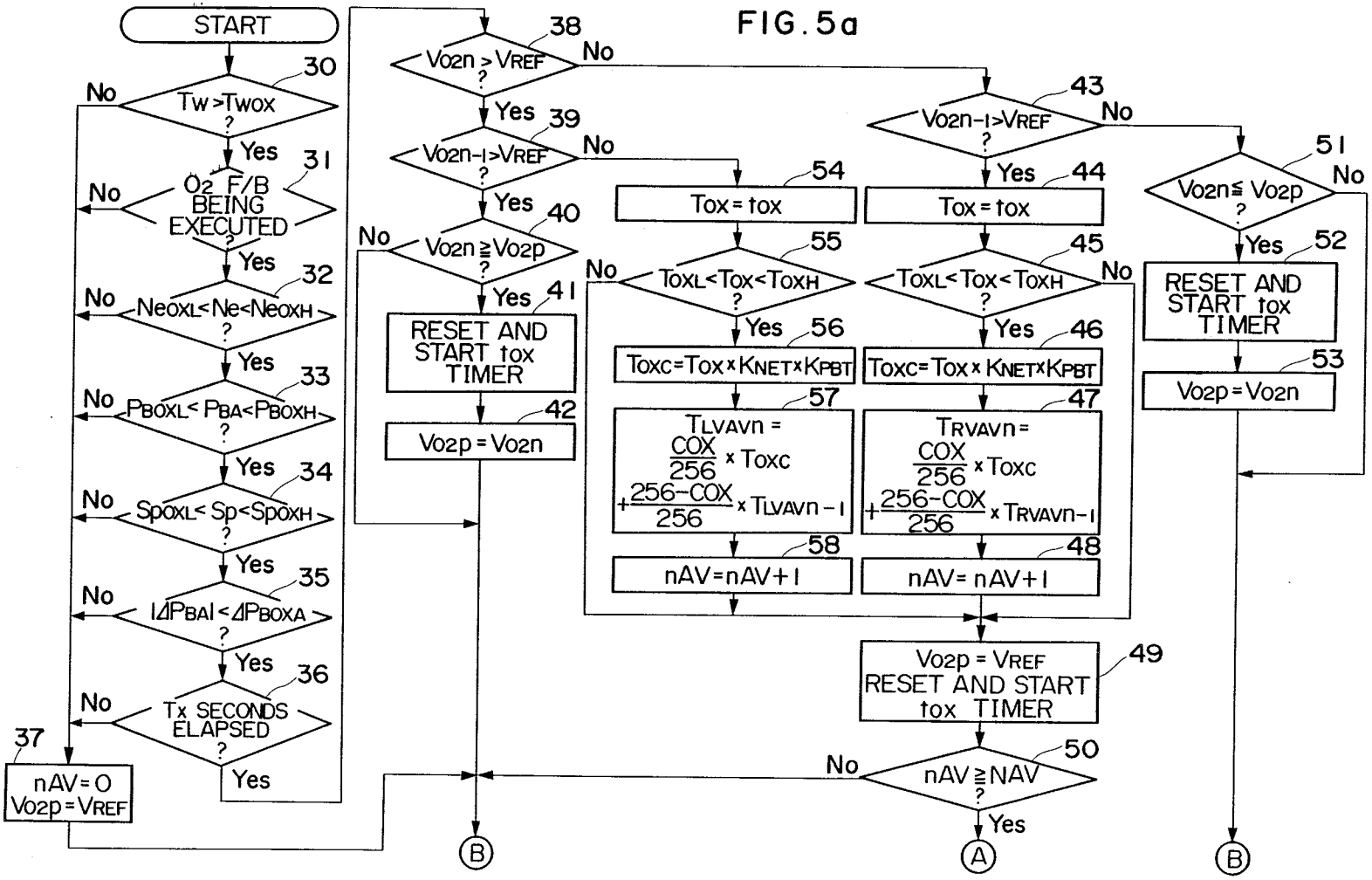
Figure 5B:
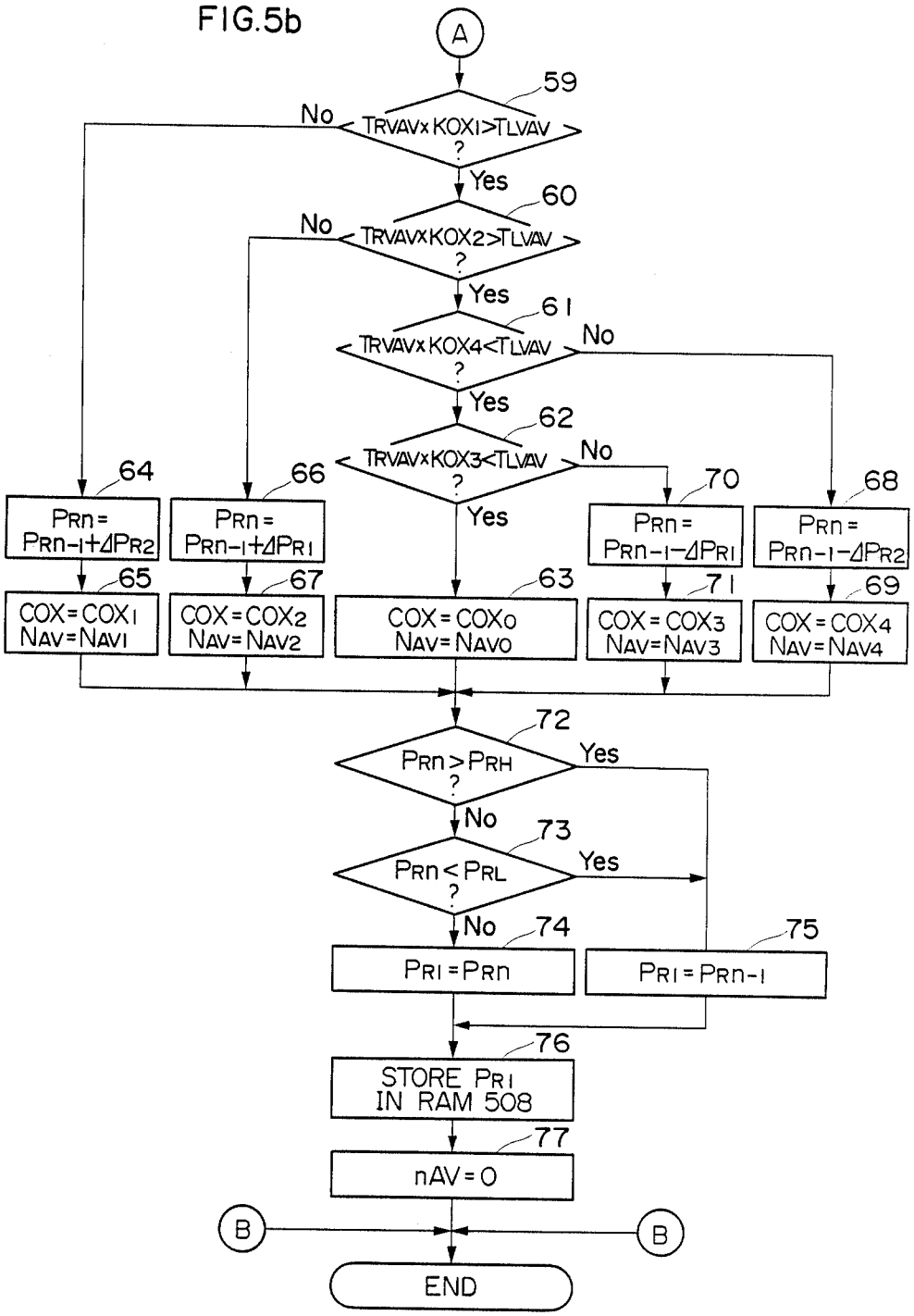

FIGS. 4 and 5 illustrate a first embodiment of the method according to the invention.

In this embodiment of the invention, a proportional control correction value PR serving as an air-fuel ratio control factor added to the correction coefficient $KO_2$ is altered in dependence upon the value of KOX. More specifically, the value of KOX is compared with a plurality of predetermined values $KOX_1-KOX_4$($KOX_1>KOX_2>KOX_3>KOX_4$), and the proportional control correction value PR is altered as follows by correction factors $\Delta PR_1$, $\Delta PR_2$ (FIG. 4):

(1) For $KOX>KOX_1$:

The air-fuel ratio is estimated to be inclining significantly to the lean side, and the correction factor $\Delta PR_2$ is added to the correction value PR.

(2) For $KOX_1>KOX>KOX_2$:

The air-fuel ratio is estimated to be inclining slightly to the lean side, and the correction factor $\Delta PR_1$($<\Delta PR_2$) is added to the correction value PR.

(3) For $KOX_2>KOX>KOX_3$:

The air-fuel ratio is estimated to have been controlled to approximately the target ratio (stoichiometric mixture) ratio, and the correction value PR is maintained as it is.

(4) For $KOX_3>KOX>KOX_4$:

The air-fuel ratio is estimated to be inclining slightly to the rich side, and the correction factor $\Delta PR_1$ is subtracted from the correction value PR.

(5) For $KOX<KOX_4$:

The air-fuel ratio is estimated to be inclining significantly to the rich side, and the correction factor $\Delta PR_2$ is subtracted from the correction value PR.

FIG. 5 illustrates a PR value determining subroutine for altering the aforementioned proportional control correction value PR on the rich side in accordance with the first embodiment of the invention. This subroutine is executed in synchronism with inputting of TDC signal.

First, it is determined through steps 30–36 whether the engine exhibits predetermined operating conditions in which the output voltage $VO_2$ of $O_2$ sensor 13 should reverse itself at a normal period.

More specifically, it is determined at the step 30 whether the temperature of the $O_2$ sensor 13 is high enough, i.e. whether the engine coolant temperature TW is higher than a predetermined value TWOX. Next, it is determined at the step 31 whether the engine is actually undergoing feedback control. This is followed by the steps 32 through 35, at which the predetermined operating conditions of the engine are examined. The step 32 calls for a determination as to whether the engine rotational speed Ne has a value between predetermined values NEOXL and NEOXH; the step 33 as to whether the absolute pressure PBA in the intake pipe has a value between predetermined values PBOXL and PBOXH; the step 34 as to whether the vehicle velocity SP, which indicates the cruising condition of the vehicle, has a value between predetermined values SPOXL and SPOXH; and the step 35 as to whether the absolute value of an amount of change ΔPBA in absolute pressure, which change indicates the stability of the cruising condition, is smaller than a predetermined range ΔPBOXA. When all of the above operating conditions hold (i.e. when all of the answers to the steps 32 through 35 are YES), it is determined at the step 36 whether these operating conditions continue to hold for a fixed time period Tx.

Figure 6:
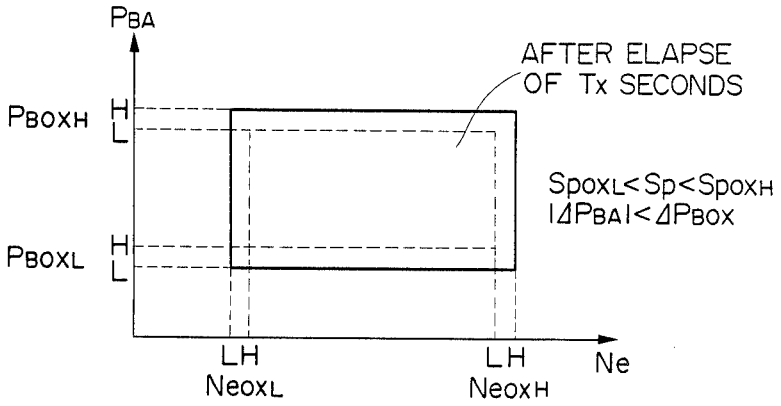
FIG. 6 is a graph illustrating an engine operating region in which the program shown in FIG. 5 is executed.

When all of the decisions rendered at the steps 30 through 36 are affirmative (the operating state shown in FIG. 6), it is judged that the engine exhibits the predetermined operating conditions and the program is executed from step 38 onward for the first time.

If any one of the answers received at the steps 30 through 36 is NO, then the program proceeds to a step 37, at which a counted value nAV indicating the number of times an averaging operation, described below, is performed is set to 0, and at which an output comparison value $VO_2P$, described below, is set to a predetermined reference value VREF, after which the present program is ended.

The processing of steps 38 through 58 is executed to calculate an average value TLVAV of the time period TLV and an average value TRVAV of the time period TRV for the purpose of determining the amount of deterioration KOX (TLV/TRV) of the $O_2$ sensor.

Figure 3:
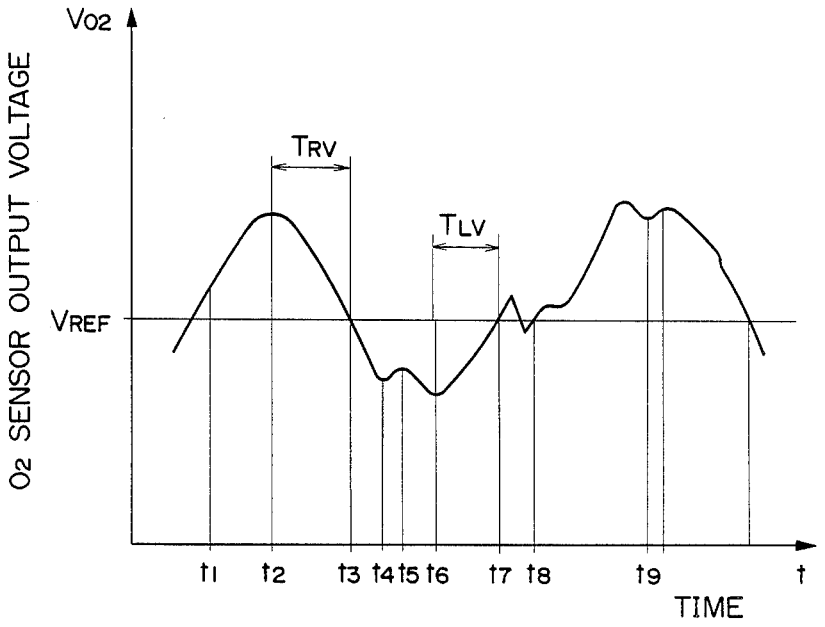
FIG. 3 is a timing chart illustrating an aging change in the output voltage $VO_2$ of an $O_2$ sensor shown in FIG. 1.

A method of calculating the average values TLVAV, TRVAV by the processing of steps 38 through 58 will now be described in conjunction with the timing chart of FIG. 3 showing the output voltage value $VO_2$ of the $O_2$ sensor.

It will be assumed that the decision rendered at the step 36 is YES for the first time at time $t_1$ in FIG. 3.

The step 38 calls for a determination as to whether the present output voltage $VO_2n$ of $O_2$ sensor is greater than the predetermined reference value VREF. The answer received at the step 38 is YES at time $t_1$ in FIG. 3, and the program proceeds to a step 39, at which it is determined whether the preceding output voltage value $VO_2n_{-1}$ is greater than the predetermined reference value VREF. The result of this decision is also YES at time $t_1$, so that the program proceeds to a step 40.

It is determined at the step 40 whether the present output voltage value $VO_2n$ is greater than the output comparison value $VO_2p$. In the present execution of this loop, a YES answer is obtained at the step 40 since the output comparison value $VO_2p$ has been set to the reference value VREF by the step 37. The program therefore proceeds to a step 41, at which the value of a count in a tOX timer at this instant is reset to zero and the timer is made to start counting again from zero. This is followed by a step 42, at which the output comparison value $VO_2p$ is set to the present output voltage value $VO_2n$ and the present program is ended. The program then proceeds to the next loop.

The output comparison value $VO_2p$ is always rewritten as the output voltage value $VO_2n$ of the $O_2$ sensor by the immediately preceding loop in the interval $t_1-t_2$. However, since the output voltage is rising even in this case, a YES answer is received at the step 40, so that execution of the steps 41, 42 is repeated.

When the output voltage value $VO_2$ of $O_2$ sensor 13 attains a peak value (maximum value) and then begins declining toward the set reference value VREF (time $t_2$ in FIG. 3), a NO answer is received at the step 40, at which time it is assumed that the output voltage value $VO_2$ attained the peak value (maximum value) between execution of the preceding loop and execution of the present loop. As a result, the steps 41, 42 are skipped and the present program is ended.

Accordingly, until the output voltage $VO_2$ of $O_2$ sensor 13 drops below the set reference value VREF, the value of the count recorded in the tOX timer is not reset and represents elapsed time from time $t_2$.

When the output voltage $VO_2$ of the $O_2$ sensor 13 falls below the set reference value VREF for the first time ($t_3$ in FIG. 3) in the present loop, the answer received at the step 38 is NO and the program proceeds to the next step 43.

The step 43 calls for a determination as to whether the output voltage value $VO_2n_{-1}$ in the immediately preceding loop is greater than the set reference value VREF. At time $t_3$, the answer received is YES. This is followed by a step 44, at which the counted value tOX (time interval $t_2-t_3$) in the tOX timer at this time is set to a shift time TOX. The program then proceeds to a step 45.

Figure 8:
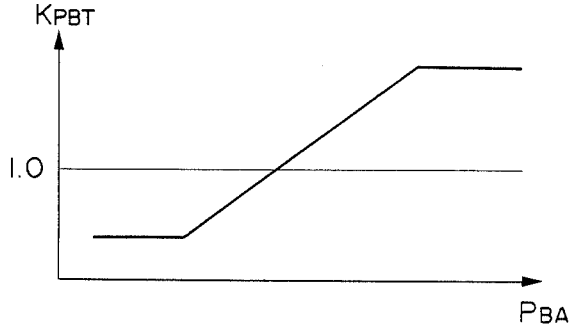
FIG. 8 is a graph illustrating the relationship between a correction coefficient KPBT and absolute pressure PBA in engine intake pipe.

It is determined at the step 45 whether the shift time TOX set at the step 44 falls within an allowable range TOXL-TOXH. When the answer is NO, steps 46 through 48, described below, are skipped, and the program proceeds to a step 49. Executing the step 45 makes it possible to eliminate a very long shift time caused during a transition in the engine operating conditions, as well as a very short shift time due to the occurrence of noise, such as appears in the interval $t_7-t_8$ in FIG. 8.

Figure 7:
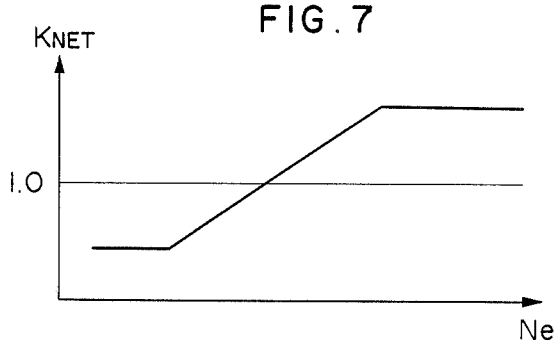
FIG. 7 is a graph illustrating the relationship between a correction coefficient KNET and engine rotational speed Ne.

When a YES answer is received at the step 45, the program proceeds to a step 46, at which the shift time TOX set as described above is multiplied by correction coefficients KNET, KPBT to yield a new shift time TOXC. The correction coefficients KNET, KPBT are values read out of a KNET-Ne table and KPBT-PBA table, shown respectively in FIGS. 7 and 8, in dependence upon the engine rotational speed Ne and absolute pressure PBA in the intake pipe, respectively. The reason for thus correcting the shift time TOX by these correction coefficients KNET, KPBT at the step 45 is that the $O_2$ sensor reversal period per se will undergo a large change in accordance with changes in the engine rotational speed Ne and absolute pressure PBA.

The shift time TOXC corrected at the step 46 is substituted into the following Equation (2) at the next step 47, as a result of which an average value TRVAVn of the shift time on the rich side of the voltage value $VO_2$ from the rich-side peak value (maximum value) to the set reference value VREF is calculated:

$$TRVAVn = \frac{COX}{256} \times TOXC + \frac{256 - COX}{256} \times TRVAVn_{-1} \quad (2)$$

where $TRVAVn_{-1}$ represents an immediately preceding value of the average value of shift time on the rich side, and COX represents an averaging constant for calculating the average value. At steps 63, 65, 67, 69 and 71 described below, COX is set to values $COX_0-COX_4$ (where $0<COX_0-COX_4<256$), which depends upon the amount of deterioration of the $O_2$ sensor.

The step 47 is followed by a step 48, at which 1 is added to the counted value nAV representing the number of times the averaging operation of Equation (2) is executed. Next, at a step 49, the output comparison value $VO_2p$ is reset to the reference value VREF, the value of the count in the tOX timer is reset and started, and the program proceeds to a step 50.

The step 50 is for determining whether the averaging of shift time by the step 47 and a step 57, described below, has been performed a predetermined number of times NAV. This determination is based on whether or not the aforementioned counted value nAV of averaging cycles is equal to or greater than the predetermined number of times NAV. It should be noted that the predetermined number NAV is set to a requisite value at steps 65, 67, 69, 71, described below, in dependence upon the amount of deterioration of the $O_2$ sensor.

When a YES answer is received at the step 50, the processing from step 59 onward is executed; if a NO answer is received, the present program is ended.

Thus, the shift time TOX (=TRV) in the interval $t_2-t_3$ is set, and the average value TRVAVn of the shift time on the rich side is calculated on the basis of the value TOXC obtained by correcting the shift time TOX.

NO answers are received at the steps 38, 43 after the output voltage value $VO_2$ of the $O_2$ sensor 13 falls below the set reference value VREF. The program then proceeds to the next step 51, at which it is determined whether the output voltage value $VO_2n$ in the present loop is equal to or less than the output comparison value $VO_2p$. In this case, the answer is YES because the value of $VO_2p$ has been set to the set reference value VREF at the step 49 of the immediately preceding loop (time $t_3$) The value of the count in the tOX timer is reset, and the timer is started, at the next step 52. This is followed by a step 53, at which the output comparison value $VO_2p$ is set to the output voltage value $VO_2n$ in the present loop, after which the present program is ended. The program then proceeds to the next loop.

The output comparison value $VO_2p$ is always rewritten as the output voltage value $VO_2n$ of the $O_2$ sensor by the immediately preceding loop in the interval $t_3-t_4$ of FIG. 3. However, since the output voltage is declining in this case, a YES answer is received at the step 51, so that execution of the steps 52, 53 is repeated.

When the output voltage value $VO_2$ of $O_2$ sensor 13 attains a peak value (minimum value) at time $t_4$ in FIG. 3 and then begins rising toward the set reference value VREF, a NO answer is received at the step 51, at which time it is assumed that the output voltage value $VO_2$ attained the peak value (minimum value) between execution of the immediately preceding loop and execution of the present loop. The steps 52, 53 are then skipped and the present program is ended. At this time, the value of the count in the timer tOX is not reset, and counting continues from time $t_4$.

If the output voltage value $VO_2$ of the $O_2$ sensor falls again (time $t_5$) before the set reference value VREF is reached and the output voltage value $VO_2n$ in the present loop drops below the output voltage value $Vo_2p$ prevailing at time $t_4$, then the answer received at the step 51 is YES and, at the step 52, the counted value in the tOX timer is reset and the timer is restarted. Accordingly, even in a case where the output voltage $VO_2$ of the $O_2$ sensor 13 attains a peak value (minimum value or maximum value) and then varies in the direction of the set reference value VREF, the tOX timer is reset if the direction of the change reverses (times $t_5$, $t_9$ in FIG. 3) before $VO_2$ crosses the reference value VREF. This makes it possible to avoid erroneous setting of the shift time TOX.

When the output voltage value $VO_2$ of the $O_2$ sensor 13 attains a peak value (minimum value) again (time $t_6$), the answer received at the step 51 is NO and elapsed time from time $t_6$ is counted by the tOX timer.

When the output voltage value $VO_2$ of the $O_2$ sensor 13 crosses the set reference value VREF (time $t_7$ onward in FIG. 3), the answer received at the step 38 is YES and the answer received at the step 39 is NO, after which the program proceeds to a step 54.

The step 54 calls for the counted value tOX (time interval $t_6-t_7$) in the tOX timer at this moment (time $t_7$) to be set to the shift time TOX (TLV), after which a step 55 calls for a determination as to whether the shift time TOX lies within the allowable range TOX-L–TOXH, as at the step 45. Then, as at the step 46, the shift time TOX is corrected by the correction coefficients KNET, KPBT, which conform respectively to the engine rotational speed Ne and absolute pressure PBA in the intake pipe, at a step 56, whereby the new shift time TOXC is obtained.

The shift time TOXC resulting from the correction is substituted into the following Equation (3) at the next step 57, as a result of which an average value TLVAVn of the shift time on the lean side of the voltage value $VO_2$ from the lean-side peak value (minimum value) to the set reference value VREF is calculated:

$$TLVAVn = \frac{COX}{256} \times TOXC + \frac{256 - COX}{256} \times TLVAVn_{-1} \quad (3)$$

where $TLVAVn_{-1}$ represents an immediately preceding value of the average value of shift time on the lean side, and COX represents an averaging constant identical with that appearing in the Equation (2).

The step 57 is followed by a step 58, at which 1 is added to the counted value nAV indicative of the number of averaging operations, just as at the step 48. The program then proceeds to the steps 49, 50.

Thus, the calculation of the average values of the shift time on the rich side and lean side through the steps 38–58 is repeated until the counted value nAV indicating the number of averaging operations attains the predetermined number NAV. The reason for this is to obtain a more accurate value of KOX (=TLVAV/TRVAV), which represents the amount of $O_2$ sensor deterioration.

When the calculation of the average value of the time for each shift to the rich side and lean side is performed the predetermined number of times NAV, and a YES answer is received at the step 50, the rich-side proportional control correction value PR corresponding to the amount of deterioration of the $O_2$ sensor 13 is revised through steps 59–77 of FIG. 5.

In the decision steps 59–62, the value KOX (=TLVAV/TRVAV) representing the amount of deterioration of the $O_2$ sensor is compared with the aforementioned predetermined values $KOX_1$, $KOX_2$, $KOX_3$ and $KOX_4$ ($KOX_1>KOX_2>KOX_3>KOX_4$). Specifically, it is determined at the step 59 whether a value obtained by multiplying the average value TRVAV of the rich-side shift time upon completion of the predetermined number of averaging operations by the predetermined value $KOX_1$ is greater than the average value TLVAV of the lean-side shift time at the end of the predetermined number of averaging operations. The step 60 calls for a determination as to whether a value obtained by multiplying the average value TRVAV by the predetermined value $KOX_2$ is greater than the average value TLVAV. On the other hand, the step 61 calls for a determination as to whether a value obtained by multiplying the average value TRVAV by the predetermined value $KOX_4$ is less than the average value TLVAV, and the step 62 calls for a determination as to whether a value obtained by multiplying the average value TRVAV by the predetermined value $KOX_3$ is less than the average value TLVAV.

Accordingly, if all of the answers received at the steps 59 through 62 are YES, the value KOX representing the amount of $O_2$ sensor deterioration lies between the predetermined values $KOX_2$ and $KOX_3$, in which case it is inferred that the air-fuel ratio has been controlled to approximately the target air-fuel ratio the program then proceeds to a step 63, at which the averaging constant COX used in Equations (2), (3) and the predetermined number NAV of averaging operations are set to standard values $COX_0$, $NAV_0$, respectively.

When a NO answer is received at the step 59, on the other hand, this means that the value of KOX is greater than the predetermined value $KOX_1$. It is inferred, therefore, that the air-fuel ratio is inclining significantly to the lean side, and the program proceeds to a step 64. Here the correction factor $\Delta PR_2$ is added to the rich-side proportional control correction value which prevailed in the immediately preceding loop, namely the preceding value $PRn_{-1}$, whereby the value in the current loop is obtained, namely the present value PRn. Next, the averaging constant COX and the predetermined number NAV are set to $COX_1$ ($>COX_0$) and $NAV_1$ ($<NAV_0$), respectively, at a step 65.

When a NO answer is received at the step 60, this means that the value of KOX lies between the predetermined values $KOX_1$, $KOX_2$. It is inferred, therefore, that the air-fuel ratio is inclining slightly to the lean side, and the program proceeds to a step 66. Here the correction factor $\Delta PR_1$ ($<\Delta PR_2$) is added to the preceding value PRn of the rich-side proportional control correction value, whereby the present value of PRn is obtained. Next, the averaging constant COX and the predetermined number NAV are set to $COX_2$ ($COX_0<COX_2<COX_1$) and $NAV_2$ ($NAV_0>NAV_2>NAV_1$), respectively, at a step 67.

When a NO answer is received at the step 61, this means that the value of KOX is less than the predetermined value $KOX_4$. It is inferred, therefore, that the air-fuel ratio is inclining significantly to the rich side, and the program proceeds to a step 68. Here the correction factor $\Delta PR_2$ is subtracted from the immediately preceding value $PRn_{-1}$ of the rich-side proportional control correction value, whereby the present value of PRn is obtained. Next, the averaging constant COX and the predetermined number NAV are set to $COX_4$ ($=COX_1$) and $NAV_4$ ($=NAV_1$), respectively, at a step 69.

When a NO answer is received at the step 62, this means that the value of KOX lies between the predetermined values $KOX_3$, $KOX_4$. It is inferred, therefore, that the air-fuel ratio is inclining slightly to the rich side, and the program proceeds to a step 70. Here the correction factor $\Delta PR_1$ is subtracted from the immediately preceding value $PRn_{-1}$ of the rich-side proportional control correction value, whereby the present value of PRn is obtained. Next, the averaging constant COX and the predetermined number NAV are set to $COX_3$ ($=COX_2$) and $NAV_3$ ($=NAV_2$), respectively, at a step 71.

Thus, the averaging rates of the shift time average values TRVAVn, TLVAVn are increased in dependence upon the amount of deterioration KOX of the $O_2$ sensor 13, namely by setting the averaging constant COX to a larger value ($COX_1$, $COX_4$) and the predetermined number NAV of averaging operations to a smaller value ($NAV_1$, $NAV_4$) when the air-fuel ratio is inclining significantly to the rich or lean side. This makes it possible to control the air-fuel ratio to the target air-fuel ratio in a rapid manner.

It is determined at steps 72, 73 whether the present value PRn of the rich-side proportional control correction value revised by the correction factor $\Delta PR_1$ or $\Delta PR_2$ at the steps 64, 66, 68, 70 is greater than an upper limit value PRH and less than a lower limit value PRL, respectively. If NO answers are received at both of the steps 72, 73, then the corrected value $PR_1$ following the revision thereof is set to the present value PRn at a step 74. If a YES answer is received at the step 72 or 73, the revised correction value PR1 is set to the immediately preceding value $PRn_{-1}$ at a step 75.

A step 76 calls for the correction value $PR_1$ thus set to be stored in the RAM 508 of FIG. 2, and the next step 77 calls for the counted value nAV indicative of the number of averaging operations to be set to zero. The present program is then ended.

The correction value $PR_1$ thus stored in the RAM 508 is used in a subroutine, described below, for calculating an $O_2$ feedback correction coefficient, whereby the value of the correction coefficient $KO_2$ can be made to incline toward the rich side or lean side.

Figure 9:
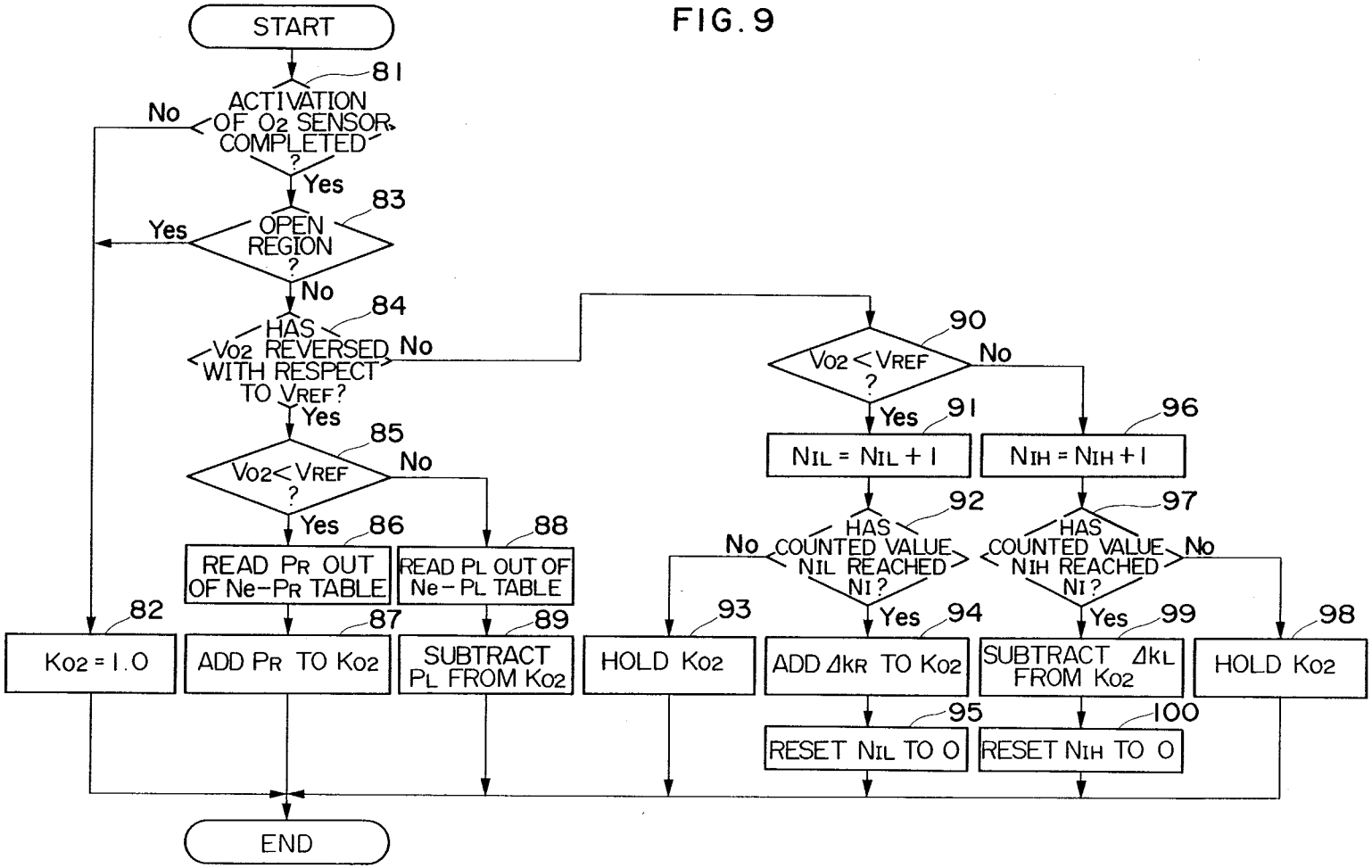
FIG. 9 is a flowchart of a subroutine for calculating an $O_2$ feedback correction coefficient $KO_2$.

FIG. 9 is a flowchart of the aforedescribed subroutine for calculation of the $O_2$ feedback correction coefficient using the rich-side proportional control correction value PR revised in the above-described manner. This subroutine is executed in synchronism with inputting of TDC signal.

In a first step 81 of the flowchart, it is determined whether activation of the $O_2$ sensor 13 has been completed. In other words, by sensing the internal resistance of the $O_2$ sensor, it is sensed whether the output voltage value of the $O_2$ sensor has reached an activation starting point Vx (e.g. 0.6 V). When Vx is attained, a decision is rendered to the effect that the sensor has been activated. If a NO answer is received at the step 81, then the correction coefficient $KO_2$ is set to 1.0 at a step 82. If the answer received at the step 81 is YES, on the other hand, it is determined at a step 83 whether the engine is operating in an open-loop control region. Open-loop control includes a high-load operating region, a low engine speed region, an idling region, a high engine speed region, a mixture-leaning region, for example. The high-load operating region is a region in which the fuel injection time TOUT is set to a value larger than a predetermined value TWOT. The latter, a constant, is a lower limit value of a fuel supply amount necessary for enriching the mixture when the engine is operating under a high load, as when the throttle valve is fully closed. The low engine speed region is a region in which the engine rotational speed Ne is less than a predetermined value NLOp (e.g. 700 rpm) and the absolute pressure PBA in the intake pipe is greater than a predetermined value PBIDL (e.g. 360 mmHg). The idling region is one in which the engine rotational speed Ne is lower than a predetermined rotational speed NHOp (e.g. 1000 rpm) and the absolute pressure PBA is lower than the predetermined pressure PBIDL. The high engine speed region is one in which the engine rotational speed Ne higher than a predetermined rotational speed NHOp (e.g. 3000 rpm). The mixture-leaning region is a region in which the absolute pressure PBA in the intake pipe is less than a predetermined value PBLS set to increasingly larger values as the engine rotational speed Ne rises. A decision is rendered to the effect that the engine is operating in the open-loop control region when the region is any of the above-mentioned. A YES decision at the step 81 sends the program to the step 82, at which the correction coefficient $KO_2$ is set to 1.0.

If the answer received at the step 83 is NO, the engine is judged to be operating in a region where feedback or closed-loop control should be carried out, so that the program proceeds to feedback or closed-loop control, in which it is judged at a step 84 whether the output voltage value $VO_2$ representing the output level of the $O_2$ sensor 13 has reversed itself with respect to the reference value VREF obtained by the reference value setting subroutine (FIG. 5) at the immediately preceding input of the TDC signal and at the present input thereof. If the answer at the step 84 is YES, proportional (P-term) control is executed from step 85 onward; if the answer is NO, then integral control (I-term control) is executed from step 90 onward.

The step 85 calls for a determination as to whether the output voltage value $VO_2$ of the $O_2$ sensor is at a low level with respect to the reference value VREF. If the answer is YES, then the correction value PR for proportional control on the rich side is read out of the Ne-PR table, which has been stored in the ROM 507, in dependence upon the engine rotational speed Ne (step 86). Next, at a step 87, the correction value PR is added to the immediately preceding value of the correction coefficient $KO_2$. If a NO answer is received at the step 85, the correction value PL for proportional control on the lean side is read out of the Ne-PL table, which has been stored in the ROM 507, at a step 88. The read correction value PL is then subtracted from the immediately preceding value of the correction coefficient $KO_2$ at a step 89.

Integral control for a case where a NO answer is received at the step 84 is performed as follows: First, it is determined at a step 90 whether the output voltage value $VO_2$ of the $O_2$ sensor 13 is at a low level with respect to the reference value VREF, just as at the step 85. If the answer received at the step 90 is YES, then the program proceeds to a step 91, at which 1 is added to the number NIL of counted TDC signal pulses. It is then determined at a step 92 whether the count NIL has attained a predetermined value NI (e.g. 4). If the result of the decision is that NIL has not yet attained NI, then the correction coefficient $KO_2$ is held at the value which prevailed in the preceding loop (step 93). If the count NIL has attained the value NI, then a correction value $\Delta kR$ for rich-side integral control conforming to the engine rotational speed Ne is added to the correction coefficient $KO_2$ at a step 94, and the number NIL of pulses counted thus far is reset to zero at a step 95. In this way, the correction value $\Delta kR$ is added to the correction coefficient $KO_2$ whenever NIL attains the value NI. If a NO answer is received at the step 90, on the other hand, then the program proceeds to a step 96, at which 1 is added to the number NIH of counted TDC signal pulses. It is then determined at a step 97 whether the count NIL has attained the predetermined value NI. If the answer is NO, then the value of the correction coefficient $KO_2$ is held at the value which prevailed in the immediately preceding loop (step 98). If the answer at the step is YES, then a correction value $\Delta kL$ for lean-side integral control is substracted from the correction coefficient $KO_2$ at a step 99, and the number NIH of counted pulses is reset to zero at a step 100. In this way, the correction value $\Delta kL$ is subtracted from the correction coefficient $KO_2$ whenever NIH attains the value NI.

By thus revising the rich-side proportional control correction value PR in dependence upon the amount of deterioration of the $O_2$ sensor 13 and applying the revised correction value PR to calculation of the $O_2$ feedback correction coefficient $KO_2$, the correction coefficient $KO_2$ can be reduced in value if the air-fuel ratio inclines to the rich side due to deterioration of the $O_2$ sensor 13, and increased in value if the air-fuel ratio inclines to the lean side due to the aforementioned deterioration. This makes it possible to bring the air-fuel ratio into agreement with the target air-fuel ratio.

In the illustrated embodiment described above, two types of correction values, namely the rich-side control correction value $\Delta kR$ and the lean-side control correction value $\Delta kL$ are used as the integral control correction values. However, it is instead permissible to use the same correction value $\Delta k$ for both rich- and lean-side control.

Figure 10:
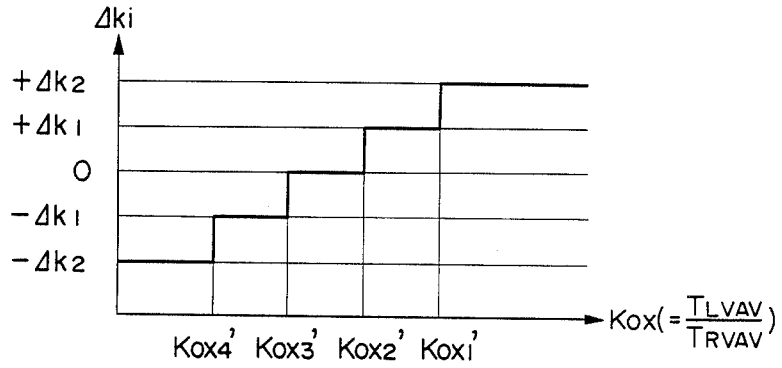
FIG. 10 is a view similar to that of FIG. 4 according to a second embodiment of the invention.
Figure 11:
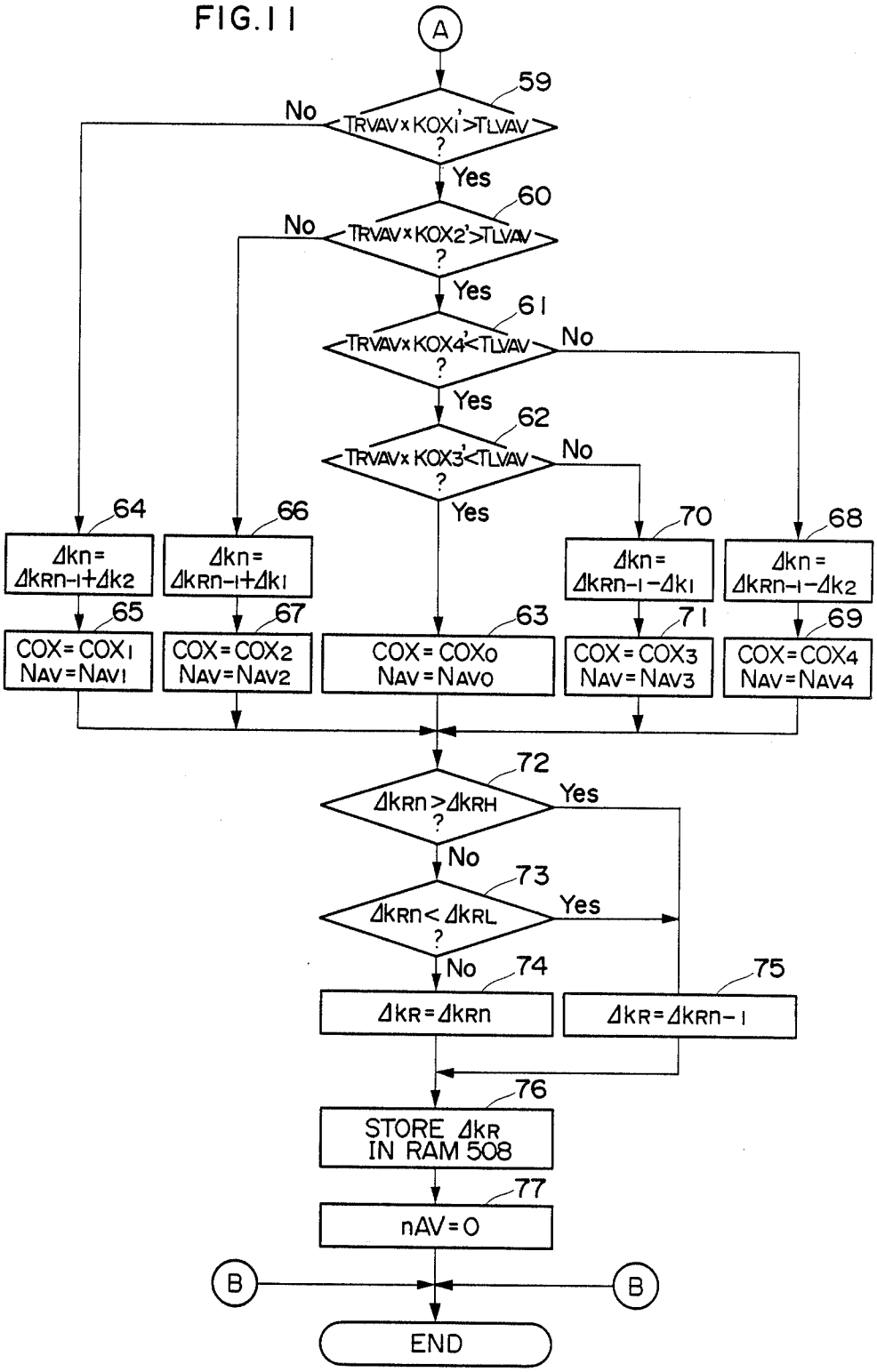
FIG. 11 is a flowchart illustrating part of a subroutine for determining an integral control correction value Δk according to the second embodiment of the invention.

FIGS. 10 and 11 illustrate a second embodiment of the invention, in which the rich-side integral control correction value $\Delta kR$ serving as an air-fuel ratio control factor added to the correction coefficient $KO_2$ is altered in dependence upon the KOX value. The steps in FIG. 11 corresponding to respective steps in FIG. 5(*b*) illustrating the first embodiment are designated by the same reference characters. In the description that follows, only the points that differentiate the second embodiment from the first will be elucitated.

Through a method identical with that of the first embodiment, the value of KOX is compared with a plurality of predetermined values $KOX_1'$–$KOX_4'$ ($KOX_1' > KOX_2' > KOX_3' > KOX_4'$), and the reference value VREF is altered as follows by correction factors $\Delta k_1$, $\Delta k_2$ (FIG. 10) in accordance with the results of the comparison operation.

(1) For $KOX > KOX_1'$:

The air-fuel ratio is estimated to be inclining significantly to the lean side, and the correction factor $\Delta k_2$ is added to the correction value $\Delta kR$.

(2) For $KOX_1' > KOX > KOX_2'$:

The air-fuel ratio is estimated to be inclining slightly to the lean side, and the correction factor $\Delta k_1$ ($\Delta k_2$) is added to the correction value $\Delta kR$.

(3) For $KOX_2' > KOX > KOX_3'$:

The air-fuel ratio is estimated to have been controlled to approximately the target ratio (stoichiometric mixture) ratio, and the correction value $\Delta kR$ is maintained as it is.

(4) For $KOX_3' > KOX > KOX_4'$:

The air-fuel ratio is estimated to be inclining slightly to the rich side, and the correction factor $\Delta k_1$ is subtracted from the correction value $\Delta kR$.

(5) For $KOX < KOX_4'$:

The air-fuel ratio is estimated to be inclining heavily to the rich side, and the correction factor $\Delta k_2$ is subtracted from the correction value $\Delta kR$.

When a NO answer is received at the step 59 in FIG. 11, the program proceeds to the step 64, where the correction factor $\Delta k_2$ is added to the value of the integral control correction value $\Delta kR$ which prevailed in the immediately preceding loop, namely the immediately preceding value $\Delta kRn_{-1}$, whereby the value in the current loop is obtained, namely the present value $\Delta kRN$. The program then proceeds to the step 65. When a NO answer is received at the step 60, the program proceeds to the step 66, where the correction factor $\Delta k_1$ ($<\Delta k_2$) is added to the immediately preceding value $\Delta kRn_{-1}$ of the correction value $\Delta kR$. The program then proceeds to the step 67. When a NO answer is received at the step 61, the program proceeds to the step 68, where the correction factor $\Delta k_2$ is subtracted from the immediately preceding value $\Delta kRn_{-1}$ of the correction value $\Delta kR$, whereby the present value $\Delta kRn$ is obtained. The program then proceeds to the step 69. When a NO answer is received at the step 62, the program proceeds to the step 70, where the correction factor $\Delta k_1$ is subtracted from the immediately preceding value $\Delta kRn_{-1}$ of the correction value $\Delta kR$, whereby the present value $\Delta kRn$ is obtained. The program then proceeds to the step 71.

It is determined at the steps 72, 73 whether the present value $\Delta kRn$ of the rich-side integral control correction value $\Delta kR$ revised by the correction factor $\Delta k_1$ or $\Delta k_2$ at the steps 64, 66, 70 is greater than an upper limit value $\Delta kRH$ and less than a lower limit value $\Delta kRL$, respectively. If NO answers are received at both of the steps 72, 73, then the corrected value $\Delta kR$ following the revision thereof is set to the present value $\Delta kRn$ at the step 74. If a YES answer is received at the step 72 or 73, the revised correction value $\Delta kR$ is set to the immediately preceding value $\Delta kRn_{-1}$ at the step 75.

The step 76 calls for the correction value $\Delta kR$ thus set to be stored in the RAM 508 of FIG. 2, and the next step 77 calls for the counted value nAV indicative of the number of averaging operations to be set to zero. The present program is then ended.

The correction value $\Delta kR$ thus stored in the RAM 508 is used in a subroutine, described below, for calculating the $O_2$ feedback correction coefficient, whereby the value of the correction coefficient $KO_2$ can be made to incline toward the rich side or lean side.

In the above embodiments, the first correction value PR for rich-side proportional control and the second correction value $\Delta kR$ for rich-side integral control are each revised in dependence upon the amount of deterioration of the $O_2$ sensor 13. However, the invention is not limited to these embodiments and the same effects can be obtained even by revising the lean-side proportional control correction value PL or the lean-side integral control correction value $\Delta kL$.

Figure 12:
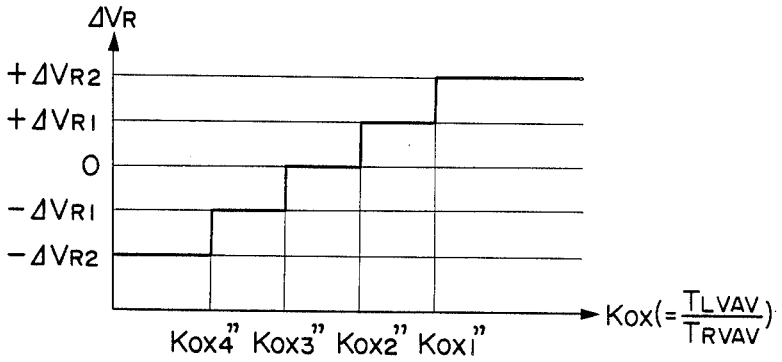
FIG. 12 is a view similar to that of FIG. 4 according to a third embodiment of the invention.
Figure 13:
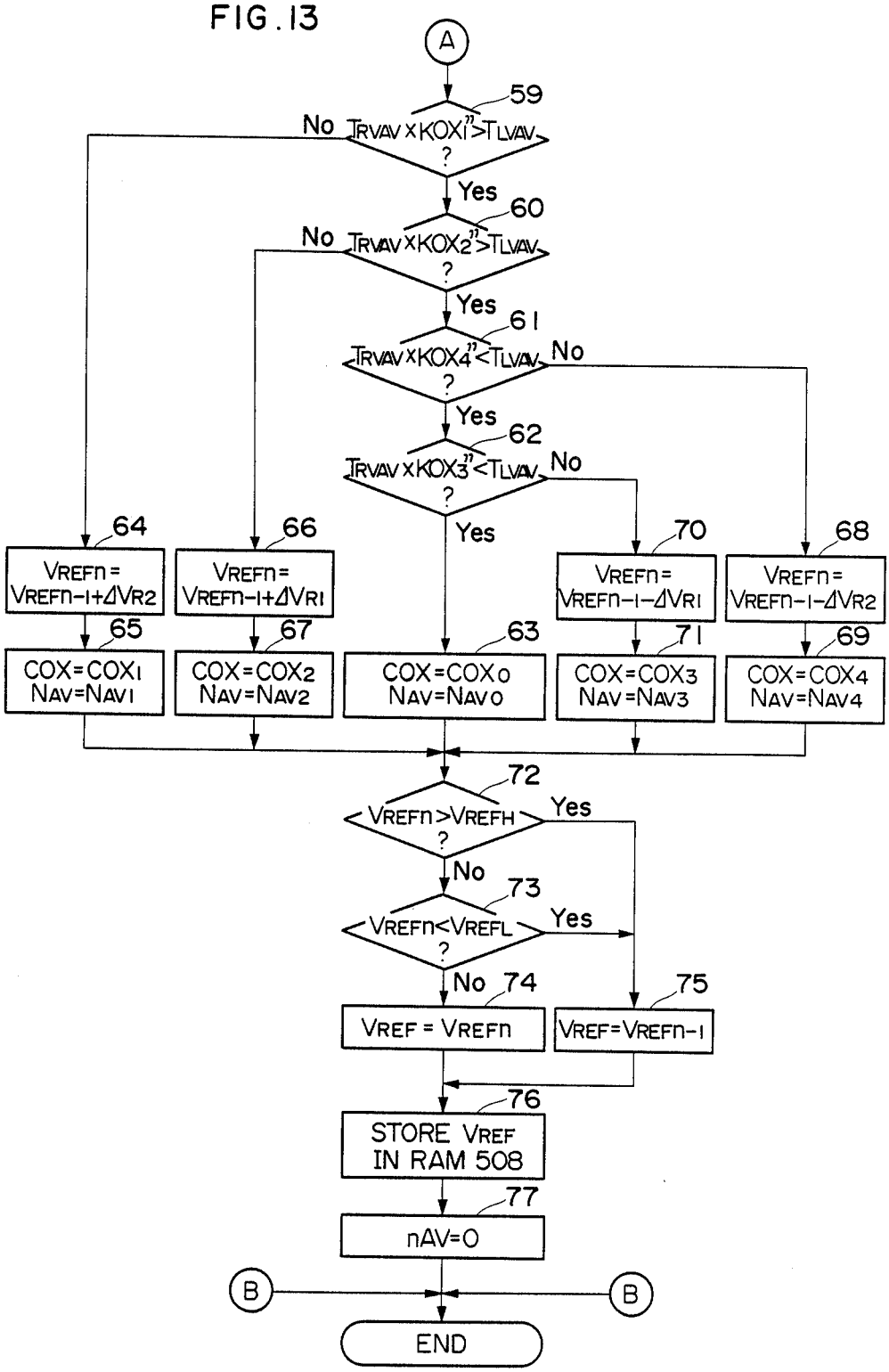
FIG. 13 is a flowchart illustrating part of a subroutine for determining a reference value VREF of an $O_2$ sensor output voltage according to the third embodiment of the invention.

FIGS. 12 and 13 illustrate a third embodiment of the invention, in which the aforementioned reference value VREF is varied as an air-fuel ratio control factor in dependence upon the KOX value to correct the air-fuel ratio's inclination toward the rich or lean side caused by deterioration of the $O_2$ sensor 13. The steps in FIG. 13 corresponding to respective steps in FIG. 5(*b*) illustrating the first embodiment are designated by the same reference characters. In the description that follows, only the points that differentiate the third embodiment from the first will be elucidated.

As in the first embodiment, the value of KOX is compared with a plurality of predetermined values $KOX_1''$–$KOX_4''$ ($KOX_1''>KOX_2''>KOX_3''>KOX_4''$), and the reference value VREF is altered as follows by correction factors $\Delta VR_1$, $\Delta VR_2$ (FIG. 12) in accordance with the results of the comparison operation:

(1) For $KOX>KOX_1''$:

The air-fuel ratio is estimated to be inclining significantly to the lean side, and the correction factor $\Delta VR_2$ is added to the reference value VREF.

(2) For $KOX_1''>KOX>KOX_2''$:

The air-fuel ratio is estimated to be inclining slightly to the lean side, and the correction factor $\Delta VR_1$ ($<VR_2$) is added to the reference value VREF.

(3) For $KOX_2''>KOX>KOX_3''$:

The air-fuel ratio is estimated to have been controlled to approximately the target ratio (stoichiometric mixture) ratio, and the reference value VREF is maintained as it is.

(4) For $KOX_3''>KOX>KOX_4''$:

The air-fuel ratio is estimated to be inclining slightly to the rich side, and the correction factor $\Delta VR_1$ is subtracted from the reference value VREF.

(5) For $KOX<KOX_4''$:

The air-fuel ratio is estimated to be inclining heavily to the rich side, and the correction factor $\Delta VR_2$ is subtracted from the reference value VREF.

When a NO answer is received at the step 59 in FIG. 13, the program proceeds to the step 64, where the correction factor $\Delta VR_2$ is added to the value of the reference value VREF which prevailed in the immediately preceding loop, namely the immediately preceding value $VREF_{-1}$, whereby the value in the current loop is obtained, namely the present value VREFn. The program then proceeds to the step 65. When a NO answer is received at the step 60, the program proceeds to the step 66, where the correction factor $\Delta VR_1$ ($<\Delta VR_2$) is added to the preceding value $VREFn_{-1}$ of the reference value VREF. The program then proceeds to the step 67. When a NO answer is received at the step 61, the program proceeds to the step 68, where the correction factor $\Delta VR_2$ is subtracted from the immediately preceding value $VREFn_{-1}$ of the reference value VREF, whereby the present value VREFn is obtained. The program then proceeds to the step 69. When a NO answer is received at the step 62, the program proceeds to the step 70, where the correction factor $\Delta VR_1$ is subtracted from the immediately preceding value $VREFn_{-1}$ of the reference value VREF, whereby the present value VREFn is obtained. The program then proceeds to the step 71.

It is determined at the steps 72, 73 whether the value VREFn, in the present loop, of the reference value VREF revised by the correction factor $\Delta VR_1$ or $\Delta VR_2$ at the steps 64, 66, 68, 70 is greater than a predetermined upper limit value VREFH and less than a predetermined lower limit value VREFL, respectively. If NO answers are received at both of the steps 72, 73, then the reference value VREFn obtained in the present loop is set to the reference value VREF at the step 74. If a YES answer is received at the step 72 or 73, the reference value $VREFn_{-1}$ obtained in the immediately preceding loop is set to the reference value VREF at the step 75.

The step 76 calls for the reference value VREF thus modified to be stored in the RAM 508 of FIG. 2, and the next step 77 calls for the counted value nAV indicative of the number of averaging operations to be set to zero. The present program is then ended.

The reference value VREF thus stored in the RAM 508 is used in the FIG. 9 subroutine, described before, for calculating the $O_2$ feedback correction coefficient, whereby the value of the correction coefficient $KO_2$ can be made to incline toward the rich side or lean side.

Thus, in the third embodiment of the invention, the reference value, which is compared with the output voltage $VO_2$ of the $O_2$ sensor 13, is revised in dependence upon the amount of deterioration of the $O_2$ sensor, and the revised reference value VREF is applied particularly to calculation of the $O_2$ feedback correction coefficient $KO_2$. As a result, the time period over which the air-fuel ratio is decided to be on the rich side due to the $O_2$ sensor deterioration can be lengthened and the value of the correction coefficient $KO_2$ reduced if the air-fuel ratio inclines to the rich side due to deterioration of the $O_2$ sensor 13, and the time period over which the air-fuel ration is decided to be on the lean side can be lengthened and the value of the correction coefficient $KO_2$ enlarged if the air-fuel ratio inclines to the lean side due to the aforementioned deterioration. This makes it possible to attain the target air-fuel ratio by controlling the air-fuel ratio to the lean or rich side in dependence upon the amount of deterioration of the $O_2$ sensor.

What is claimed is:

1. In a method of feedback-controlling an air-fuel ratio of a mixture supplied to an internal combustion engine having an exhaust system and a sensor arranged in said exhaust system for sensing a concentration of an exhaust gas, including comparing an output value from said exhaust gas concentration sensor and a predetermined reference value, and feedback-controlling said air-fuel ratio of the mixture to a desired value by at least one of proportional control and integral control depending upon results of the comparison, said proportional control including correcting said air-fuel ratio by a first correction value when said output value from the exhaust gas concentration sensor changes from a rich side to a lean side or vice versa with respect to said predetermined reference value, and said integral control including correcting said air-fuel ratio by a second correction value whenever a predetermined time period elapses, as long as said output value from the exhaust gas concentration sensor is on the lean side or rich side with respect to said predetermined reference value, the improvement comprising the steps of:

(a) calculating a first time period required for said output value from the exhaust gas concentration sensor to make a transition from a peak value on the rich side to said predetermined reference value with respect to said predetermined reference value;

(b) calculating a second time period required for said output value to make a transition from a peak value on the lean side to said predetermined reference value with respect to said predetermined reference value;

(c) obtaining a ratio of said calculated first time period to said calculated second time period; and (d) altering, in dependence upon said ratio obtained in said step (c), a value of at least one predetermined control factor applied to control of said air-fuel ratio.

2. The method as claimed in claim 1, wherein said predetermined control factor is said first correction value applied to said proportional control.

3. The method as claimed in claim 1, wherein said predetermined control factor is said second correction value applied to said integral control.

4. The method as claimed in claim 1, wherein said predetermined control factor is said predetermined reference value compared with said output value from the exhaust gas concentration sensor.

5. The method as claimed in claim 1, wherein the value of said predetermined control factor is altered by a larger amount when said ratio of said first time period to said second time period indicates an increase in a deviation of said air-fuel ratio from said desired value.

6. The method as claimed in claim 1, wherein said calculated first time period and said calculated second time period are corrected by at least one parameter representing an operating condition of the engine.

7. The method as claimed in claim 6, wherein said at least one parameter comprises rotational speed of the engine and pressure in an intake pipe of the engine.

8. The method as claimed in claim 6, wherein said calculated first time period and said calculated second time period are corrected only when said first time period and said second time period lie within respective predetermined ranges.

9. The method as claimed in claim 1 or claim 6, further comprising the steps of calculating said first time period and said second time period each a predetermined number of times, calculating a first average value of said first time period calculated said predetermined number of times and a second average value of said second time period calculated said predetermined number of times, obtaining a ratio of said first average value to said second average value, and altering the value of said at least one predetermined control factor in dependence upon the ratio obtained.

10. The method as claimed in claim 9, wherein said predetermined number of times is set to a smaller value when said ratio of said first time period to said second time period indicates an increase in a deviation of said air-fuel ratio from said desired value.

11. The method as claimed in claim 9, wherein an averaging rate of said first time period and of said second time period is set to a larger value when said ratio of said first time period to said second time period indicates an increase in a deviation of said air-fuel ratio from said desired value.

12. The method as claimed in claim 1, wherein said altered control factor is applied to control of said air-fuel ratio only when said altered control factor lies within a predetermined range.

13. The method as claimed in claim 1, wherein said steps (a) through (d) are executed only when said air-fuel ratio is feedback-controlled.

* * * * *